US005676538A

United States Patent [19]

Lovett

[11] Patent Number: 5,676,538

[45] Date of Patent: Oct. 14, 1997

[54] FUEL NOZZLE FOR LOW-NOX COMBUSTOR BURNERS

[75] Inventor: Jeffery Allan Lovett, Scotia, N.Y.

[73] Assignee: General Electric Company, Schenectady, N.Y.

[21] Appl. No.: 503,295

[22] Filed: Jul. 17, 1995

Related U.S. Application Data

[63] Continuation of Ser. No. 82,699, Jun. 28, 1993, abandoned.

[51] Int. Cl.[6] ..... F23M 9/00

[52] U.S. Cl. ..... 431/182; 431/187; 431/350; 60/749

[58] Field of Search ..... 431/8, 181, 187, 431/345, 3, 350; 239/552, 533, 568.1; 60/261, 749, 725

[56] References Cited

U.S. PATENT DOCUMENTS

| | | | |
|---|---|---|---|
| 2,360,548 | 10/1944 | Conway | 431/187 |
| 3,944,142 | 3/1976 | Welden | 239/552 |
| 3,974,646 | 8/1976 | Markowski et al. | 60/261 |
| 4,223,615 | 9/1980 | Breen et al. | 431/8 |
| 4,303,386 | 12/1981 | Voorheis et al. | 431/177 |
| 5,095,696 | 3/1992 | Gulati et al. | 60/261 |
| 5,129,226 | 7/1992 | Bigelow et al. | 60/261 |

FOREIGN PATENT DOCUMENTS

| | | | |
|---|---|---|---|
| 1229519 | 5/1986 | U.S.S.R. | 431/182 |

*Primary Examiner*—James C. Yeung
*Attorney, Agent, or Firm*—Marvin Snyder

[57] ABSTRACT

This invention relates to low NOx combustor burners of the type that employ an irregular edge at the edge of the center hub of the combustor burner. Such structures of this type, generally, reduce the strength of combustion instabilities by disrupting the coherent vortices shed from the center hub section of the burner.

10 Claims, 1 Drawing Sheet

FUEL NOZZLE FOR LOW-NOX COMBUSTOR BURNERS

This application is a Continuation of application Ser. No. 08/082,699, filed Jun. 28, 1993, abandoned.

BACKGROUND OF THE INVENTION

1. Field of the Invention

This invention relates to low NOx combustor burners of the type that employ an irregular edge at the edge of the center hub of the combustor burner. Such structures of this type, generally, reduce the strength of combustion instabilities by disrupting the coherent vortices shed from the center hub section of the burner.

1. Description of the Related Art

It is known in low NOx-emission type combustors which employ lean premix combustion to employ a multiple number of burners assembled into one combustion unit. As shown in FIG. 1, the typical burner 2 consists of a flow tube 4 with a center hub 6 to support fuel injectors 8 and swirl vanes 10. The flame 12 produced at the exit of burner 2 is stabilized by a combination of bluff-body recirculation behind the center hub 6, and swirl breakdown, if swirl is present. With the premixed systems, strong combustion instabilities exist which can lead to fatigue failure, flame blowup, and limit the operating range of combustor 2.

Premixed combustion systems, as shown in FIG. 1, typically, produce strong oscillations or noise as a result of combustion instabilities. These combustion instabilities or noise have been related to the shedding of spanwise vortices 14 from the edge of the flame holder, in this case the end of fuel nozzle hub 6. The coupling between these spanwise vortices 14 and the combustion produces strong instabilities or noise which limit operation. Therefore, a more advantageous system, then, would be presented if spanwise vortices could be disrupted or broken up, thereby significantly reducing the strength of combustion instability.

It is also known, in aircraft engines, that large unsteady pressure oscillations termed "screech" can occur under some conditions when unsteady heat release couples with the acoustic pressure fluctuations. Screech if not suppressed, can result in instantaneous disintegration of the afterburner hardware such a flameholder, fuel injector, liner and so on. Conventional flame stabilizers, such as those set forth in commonly assigned U.S. Pat. Nos. 5,095,696 to Gulati et al. and 5,129,226 to Bigelow et al., disclose various flameholders which are used to suppress combustion-induced screech. While these systems have met with a degree of commercial success, they produce various vortices along the flameholder in order to reduce the combustion-induced screech.

It is apparent from the above that there exists a need in the art for a fuel nozzle for low NOx combustion burners which is capable of premixing the fuel, and which at least equals the noise reduction characteristics of the known aircraft turbine engines, particularly those of the highly advantageous type disclosed in the above referenced Gulati et al. and Bigelow patents, but which at the same time is able to reduce the strength of combustion instabilities by disrupting the coherent vortices shed from the center hub 6. It is a purpose of this invention to fulfill this and other needs in the art in a manner more apparent to the skilled artisan once given the following disclosure.

SUMMARY OF THE INVENTION

Generally speaking, this invention fulfills these needs by providing a premixed combustor, comprising a flow tube means, a fuel injection means located substantially within said flow tube means, a fuel nozzle hub means located adjacent to said flow tube means such that said nozzle means includes a first and second ends such that said first end is located adjacent to said fuel injection means, and a fluted and serrated edge located substantially on said second end of said fuel nozzle hub such that said edge substantially disrupts a vortex produced substantially along said fuel nozzle hub means.

In certain preferred embodiments, the fluted and serrated edge is comprised of angular tabs located around the circumference of the fuel nozzle hub.

In another further preferred embodiment, substantially all of the coherent vortices shed from the center huh section of the combustor are disrupted which will reduce the strength of the combustion instabilities and thus reduce the noise within the combustor.

The preferred low-NOx combustor burner, according to this invention, offers the following advantages: excellent combustor characteristics; reduced NOx; improved flame stability; good economy; good durability; disruption of coherent vortices and reduced noise. In fact, in many of the preferred embodiments, the factors of disruption of vortices and reduced noise is optimized to an extent that is considerably higher than heretofore achieved in prior, known combustor burners.

BRIEF DESCRIPTION OF THE DRAWINGS

The above and other features of the present invention which will be more apparent as the description proceeds are best understood by considering the following detailed description in conjunction with the accompanying drawings wherein like character represent like parts throughout the several views and in which.

DETAILED DESCRIPTION OF THE INVENTION

Figure 1:
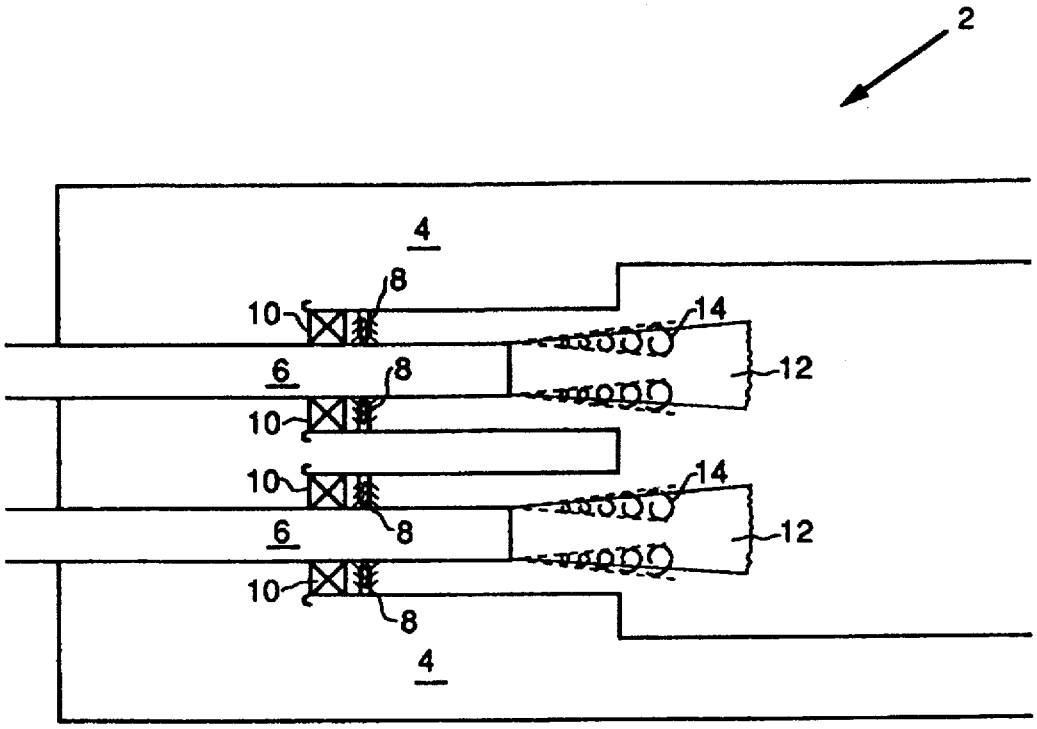
FIG. 1 (PRIOR ART)
FIG. 1 is a schematic illustration of a combustor burner, according to the prior art.

As discussed earlier, FIG. 1 is a schematic illustration of a combustor burner according to the prior art. Burner 2 includes, in part, flow tube 4, center fuel nozzle hub 6, fuel injectors 8, swirl vanes 10, flame 12, and vortices 14. While combustor 2 is capable of producing lean-premixed combustion, vortices 14 produced from center hub nozzle 6 create strong combustion instabilities and noise which can lead to fatigue failure, flame blowup, and limit the operating range of combustor 2.

Figure 2:
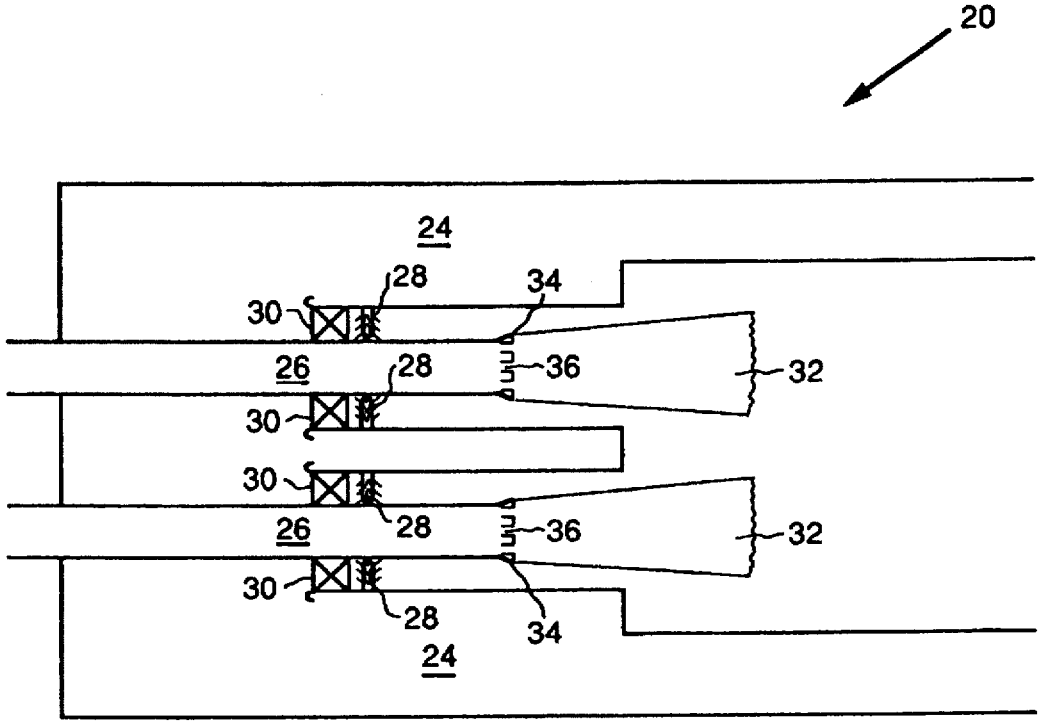
FIG. 2 is a schematic illustration of a low-NOx, low noise combustor burner, according to the present invention.

With reference to FIG. 2, there is illustrated low NOx combustor 20. Combustor 20 includes, in part, flow tube 24, center fuel nozzle hub 26, fuel injector 28, swirl vanes 30, flame 32, tab 34, and space 36. As can be seen in FIG. 2, tabs 34 and spaces 36 create a fluted-serrated edge around the circumference of fuel nozzle hub 26. It is to be understood that tabs 34 can also be fins and spaces 36 can also be grooves.

During the operation of combuster 20, flame 32 which is produced at the exit of combustor 20 is stabilized by a combination of bluff-body recirculation behind center hub 26 and swirl breakdown, if swirl is present. A strong shear layer is produced at the interface between the flow stream exiting burner 20 and the recirculation at the end of hub 26. Instabilities in the shear layer produce a train of vortices (FIG. 1) which couple with the combustion to produce strong oscillations. Tabs 34 and spaces 36 along the downstream edge of hub 26 will break up the spanwise vortices shed from the edge of hub 26. Once these spanwise vortices are disrupted or broken up, the strength of the combustion instabilities can be significantly reduced which, thereby, significantly reduces the noise produced with the combustor 20.

Once given the above disclosure, many other features, modification or improvements will become apparent to the skilled artisan. Such features, modifications or improvements are, therefore, considered to be a part of this invention, the scope of which is to be determined by the following claims.

What is claimed is:

1. A low NOx combustor comprising:

a flow tube for receiving air;

a combustion liner disposed in said tube and having an upstream portion for receiving air from said flow tube, and having a downstream portion defining a combustion zone;

a center fuel nozzle cylindrical hub disposed in part in said flow tube, and having an imperforate, bluff downstream end disposed in said liner upstream portion and spaced upstream from said combustion zone;

a plurality of fuel injectors extending radially between said nozzle hub and said liner upstream portion, and spaced upstream of said hub bluff end for injecting fuel into said air channeled through said liner upstream portion for producing a flame downstream of said hub bluff end in said combustion zone; and means disposed at said hub bluff end and spaced in major part radially inwardly from said liner upstream portion for disrupting spanwise vortices shed from said hub bluff end.

2. A combustor according to claim 1 wherein said disrupting means comprise a plurality of circumferential interruptions in a radially outer downstream edge of said hub at said hub bluff end.

3. A combustor according to claim 2 wherein said disrupting means further comprise a plurality of circumferentially spaced apart tabs and intervening spaces.

4. A combustor according to claim 3 wherein said tabs are in the form of fins, and said spaces are in the form of grooves.

5. A combustor according to claim 3 wherein said tabs are angular relative to said hub.

6. A combustor according to claim 3 wherein said tabs and spaces define said downstream edge as being both fluted and serrated.

7. A combustor according to claim 3 further comprising swirl vanes extending radially between said hub and said liner upstream portion, and disposed upstream of said fuel injectors for swirling said air prior to mixing with said fuel from said injectors inside said liner upstream portion, and wherein said disrupting means are further effective for breaking down said swirl air.

8. A combustor according to claim 7 wherein said tabs are in the form of fins, and said spaces are in the form of grooves.

9. A combustor according to claim 7 wherein said tabs are angular relative to said hub.

10. A combustor according to claim 7 wherein said tabs and spaces define said downstream edge as being both fluted and serrated.

* * * * *